US008726920B2

(12) United States Patent
Ko

(10) Patent No.: US 8,726,920 B2
(45) Date of Patent: May 20, 2014

(54) TELESCOPIC TUBE STRUCTURE FOR AUTOMATIC UMBRELLAS

(76) Inventor: Chin-Sung Ko, Homei Township, Changhua County (TW)

( * ) Notice: Subject to any disclaimer, the term of this patent is extended or adjusted under 35 U.S.C. 154(b) by 234 days.

(21) Appl. No.: 13/152,276

(22) Filed: Jun. 3, 2011

(65) Prior Publication Data

US 2012/0305038 A1 Dec. 6, 2012

(51) Int. Cl.
*A45B 25/14* (2006.01)
*A45B 25/16* (2006.01)
*A45B 19/08* (2006.01)

(52) U.S. Cl.
USPC ..... 135/24; 135/25.4

(58) Field of Classification Search
USPC ..... 135/22, 24, 25.1, 25.4
See application file for complete search history.

(56) References Cited

U.S. PATENT DOCUMENTS 5,617,889 A * 4/1997 Wu ..... 135/22
5,803,102 A * 9/1998 Ko ..... 135/24
6,145,522 A * 11/2000 Ko ..... 135/24
8,225,805 B2 * 7/2012 Wu et al. ..... 135/24
8,365,747 B1 * 2/2013 Su ..... 135/24
2002/0062850 A1 * 5/2002 Kuo ..... 135/24
2011/0114142 A1 * 5/2011 Cai ..... 135/22
2011/0214704 A1 * 9/2011 Chang ..... 135/23
2013/0074892 A1 * 3/2013 Tan ..... 135/24

* cited by examiner

*Primary Examiner* — David R Dunn
*Assistant Examiner* — Danielle Jackson
(74) *Attorney, Agent, or Firm* — Leong C. Lei

(57) ABSTRACT

A telescopic tube structure for automatic umbrellas includes a tube assembly comprised of an outer tube, a middle tube, and an inner tube, which are telescopically interconnected; wherein a plug is fixedly fitted into a top portion of the middle tube, a bullet-shaped element is provided in the tube assembly, a runner string is connected to the bullet-shaped element at a first end thereof, and is sequentially looped around a first runner-string pulley at a top portion of the tube assembly and a second runner-string pulley of a runner and then connected to a cap at a second end thereof, an outer-tube string is connected to the bullet-shaped element at a first end thereof, and is looped around an outer-tube string pulley of the plug and connected to a bottom portion of the outer tube at a second end thereof. The structure may allow umbrellas to be operated more conveniently.

1 Claim, 20 Drawing Sheets

TELESCOPIC TUBE STRUCTURE FOR AUTOMATIC UMBRELLAS

TECHNICAL FIELD OF THE INVENTION

The present invention relates to a tube structure for umbrellas and, more particularly, to a telescopic tube structure for automatic umbrellas.

DESCRIPTION OF THE PRIOR ART

Umbrellas are common devices for daily life. With a rise of living standard, they are required to contain more functions for ease of operation. Although the existing umbrellas are constructed in a manner that each can be opened automatically or contains a function that allows the canopy thereof to be folded automatically, the tube or rod thereof still should be retracted manually. Thus, there is a need for further improvement on the closing operation of an umbrella.

SUMMARY OF THE INVENTION

The primary object of the present invention is to provide a telescopic tube structure for automatic umbrellas, which can provide an automatic retraction of a tube to bring more convenience in closing an umbrella than the existing umbrellas.

According to a technical means of the present invention, a telescopic tube structure includes a tube assembly comprised of an outer tube, a middle tube, and an inner tube, which are telescopically interconnected; wherein a plug is fixedly fitted into a top portion of the middle tube, a bullet-shaped element is provided in the tube assembly, a runner string is provided in the tube assembly, the runner string being connected to the bullet-shaped element at a first end thereof, and being sequentially looped around a first runner-string pulley at a top portion of the tube assembly and a second runner-string pulley of a runner and then connected to a cap at a second end thereof, an outer-tube string is provided in the tube assembly, the outer-tube string being connected to the bullet-shaped element at a first end thereof, and being looped around an outer-tube string pulley of the plug and then connected to a bottom portion of the outer tube at a second end thereof.

According to another technical means of the present invention, a telescopic tube structure includes a tube assembly comprised of an outer tube, a middle tube, and an inner tube, which are telescopically interconnected; wherein a plug is fixedly fitted into a top portion of the middle tube, a bullet-shaped element is provided in the tube assembly, a runner string and an outer-tube string are formed as an integral string looped around a pin of the bullet-shaped element, the integral string being sequentially looped around a first runner-string pulley at a top portion of the tube assembly and a second runner-string pulley of a runner and then connected to a cap at one end thereof, and being looped around an outer-tube string pulley of the plug and then connected to a bottom portion of the outer tube at another end thereof.

According to still another technical means of the present invention, a telescopic tube structure includes a tube assembly comprised of an outer tube, a middle tube, and an inner tube, which are telescopically interconnected; wherein a plug is fixedly fitted into a top portion of the middle tube, a bullet-shaped element and a sliding block are provided in the tube assembly, a runner string is provided in the tube assembly, the runner string being connected to the sliding block at a first end thereof, and being looped around a first runner-string pulley at a top portion of the tube assembly and then connected to a runner at a second end thereof, an outer-tube string is provided in the tube assembly, the outer-tube string being connected to the sliding block at a first end thereof, and being looped around an outer-tube string pulley of the plug and then connected to a bottom portion of the outer tube at a second end thereof; and further wherein a protective sleeve and a bullet-shaped element string is provided in the tube assembly, the bullet-shaped element string being connected to a bottom portion of the protective sleeve at a first end thereof and being connected to the bullet-shaped element at a second end thereof.

According to still another technical means of the present invention, a telescopic tube structure includes a tube assembly comprised of an outer tube, a middle tube, and an inner tube, which are telescopically interconnected; wherein a plug is fixedly fitted into a top portion of the middle tube, a bullet-shaped element and a sliding block are provided in the tube assembly, a runner string and an outer-tube string are formed as an integral string looped around a pin of the sliding block, the integral string being looped around a first runner-string pulley at a top portion of the tube assembly and then connected to a runner at one end thereof; and being looped around an outer-tube string pulley of the plug and then connected to a bottom portion of the outer tube at another end thereof; and further wherein a protective sleeve and a bullet-shaped element string is provided in the tube assembly, the bullet-shaped element string being connected to a bottom portion of the protective sleeve at a first end thereof and being connected to the bullet-shaped element at a second end thereof.

An advantageous effect of the present invention is that, when closing an umbrella, the outer-tube string allows the middle tube to retract into the outer tube automatically. Thus, the user can save one manual operation of retracting the middle tube. This may bring more convenience in operating an umbrella.

Other objects, advantages, and novel features of the present invention will become more apparent from the following detailed description when taken in conjunction with the accompanying drawings.

DETAILED DESCRIPTION OF THE PREFERRED EMBODIMENTS

The embodiments illustrated in the following paragraphs are preferred examples to be implemented for the present invention, which are not construed as a limitation of implementing the present invention.

Figure 1:
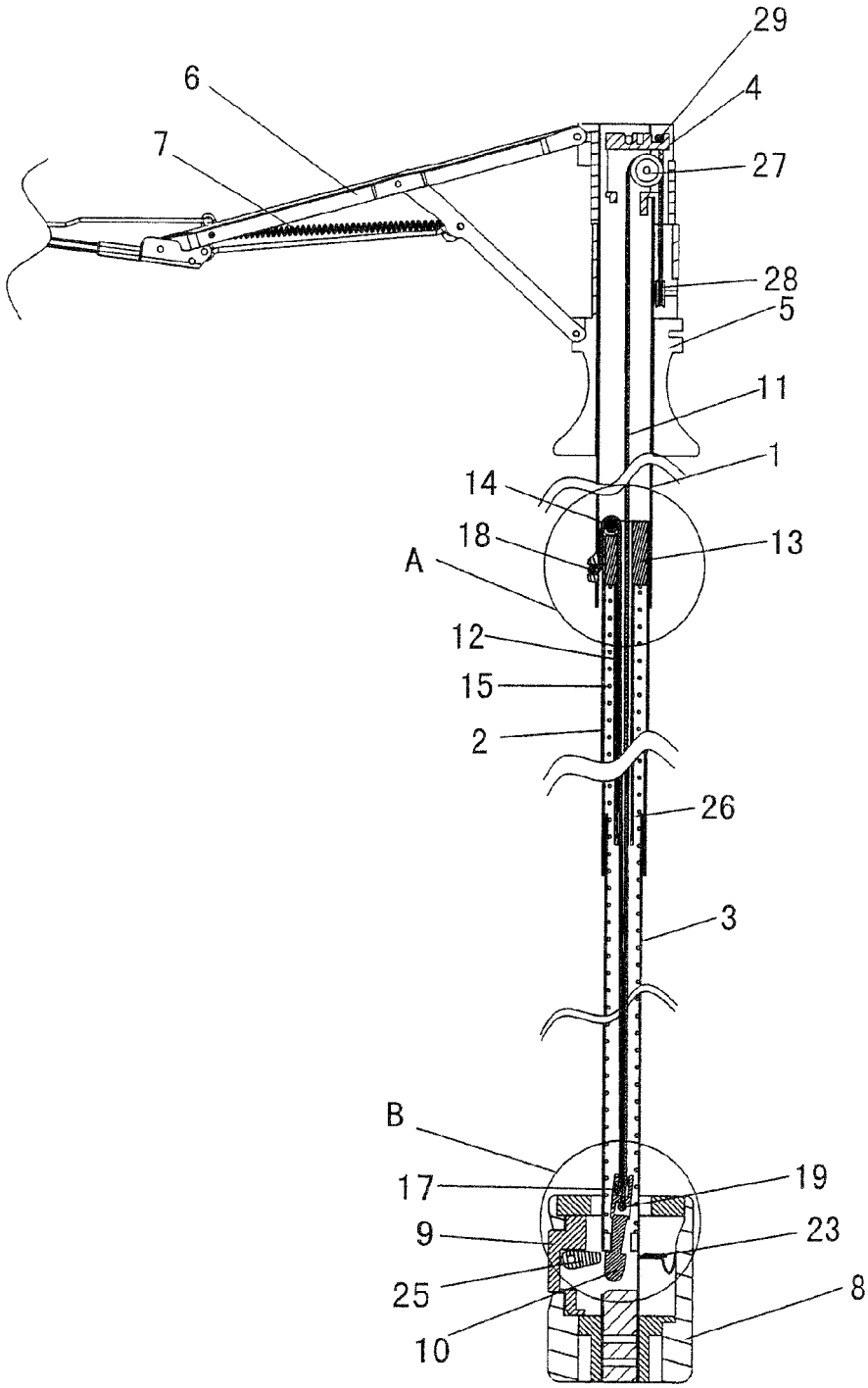
FIG. 1 is a sectional view, which schematically shows an opened state of a first embodiment of the present invention.
Figure 2:
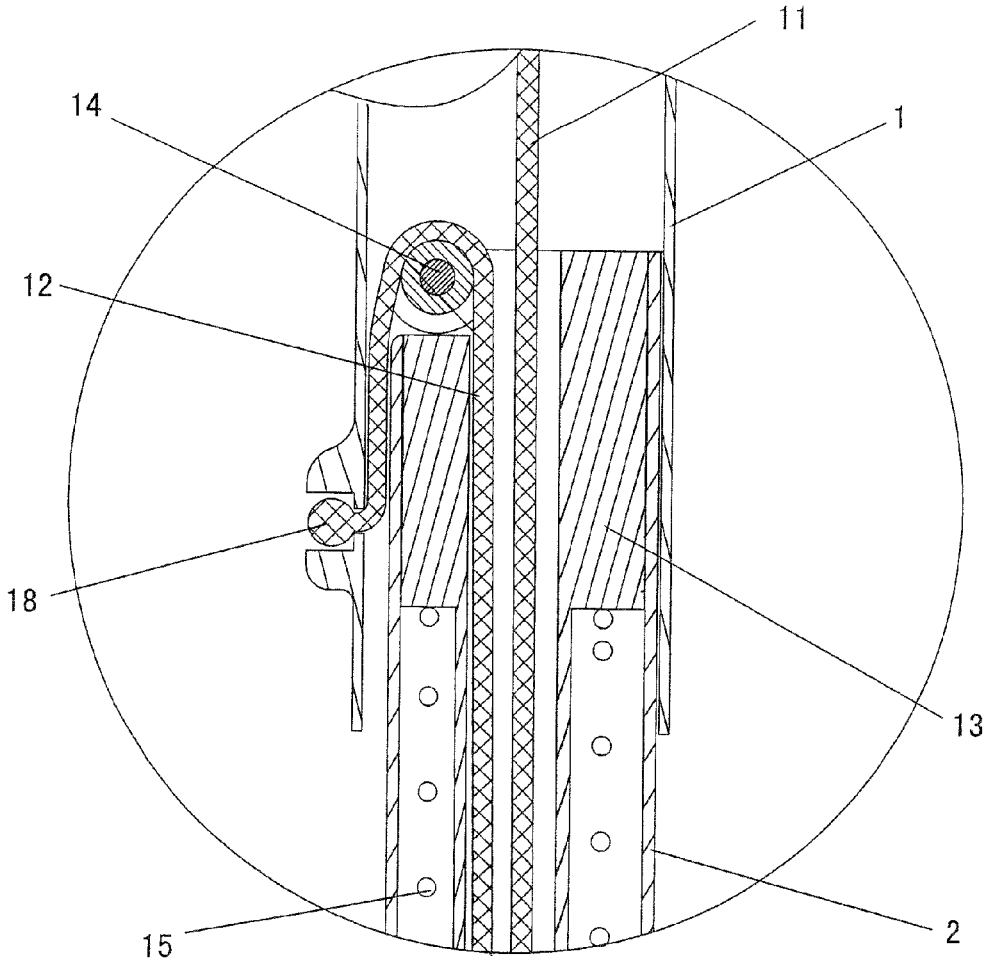
FIG. 2 is an enlarged fragmentary view, which shows the portion A in FIG. 1.
Figure 3:
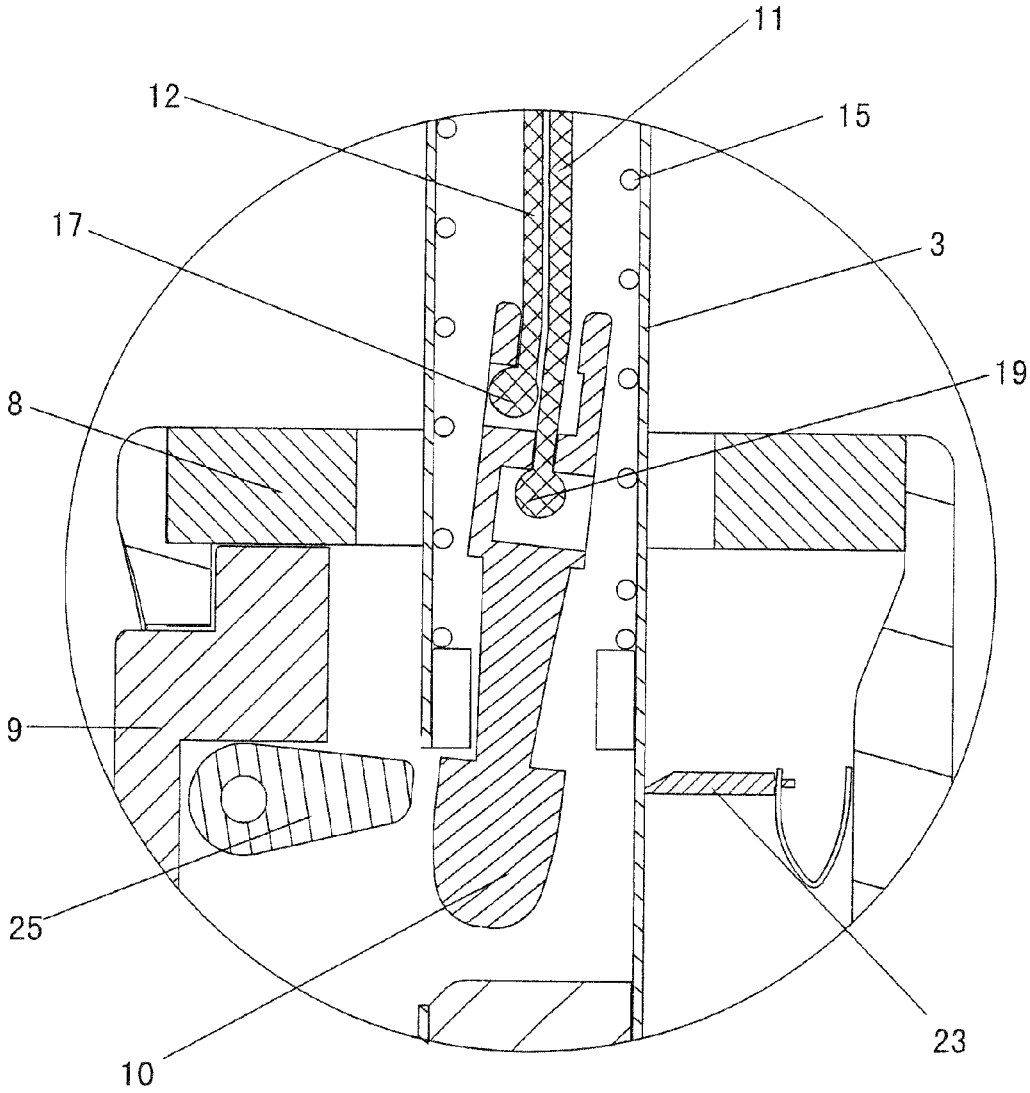
FIG. 3 is an enlarged fragmentary view, which shows the portion B in FIG. 1.
Figure 4:
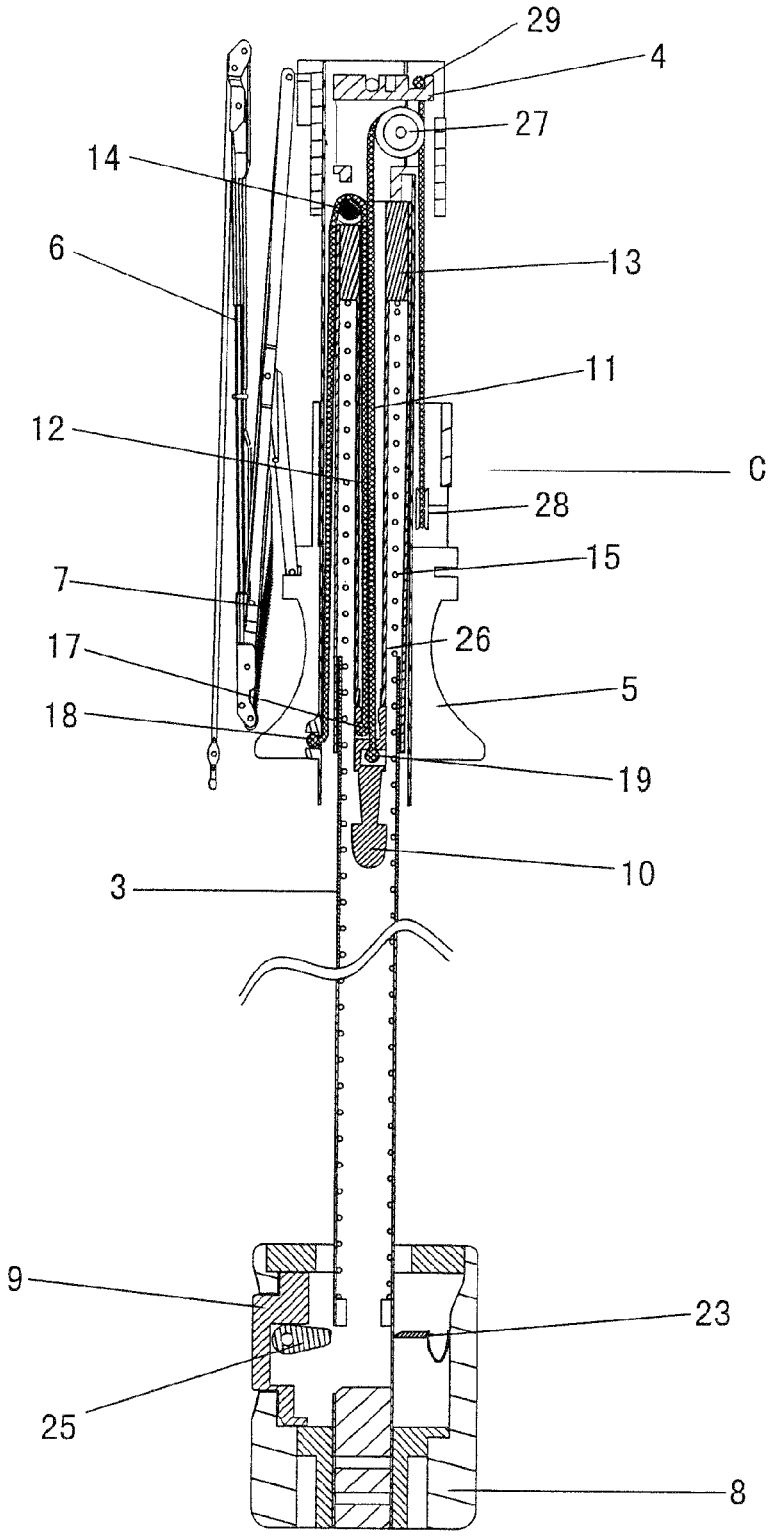
FIG. 4 is a sectional view, which schematically shows a closed state of the first embodiment of the present invention.
Figure 5:
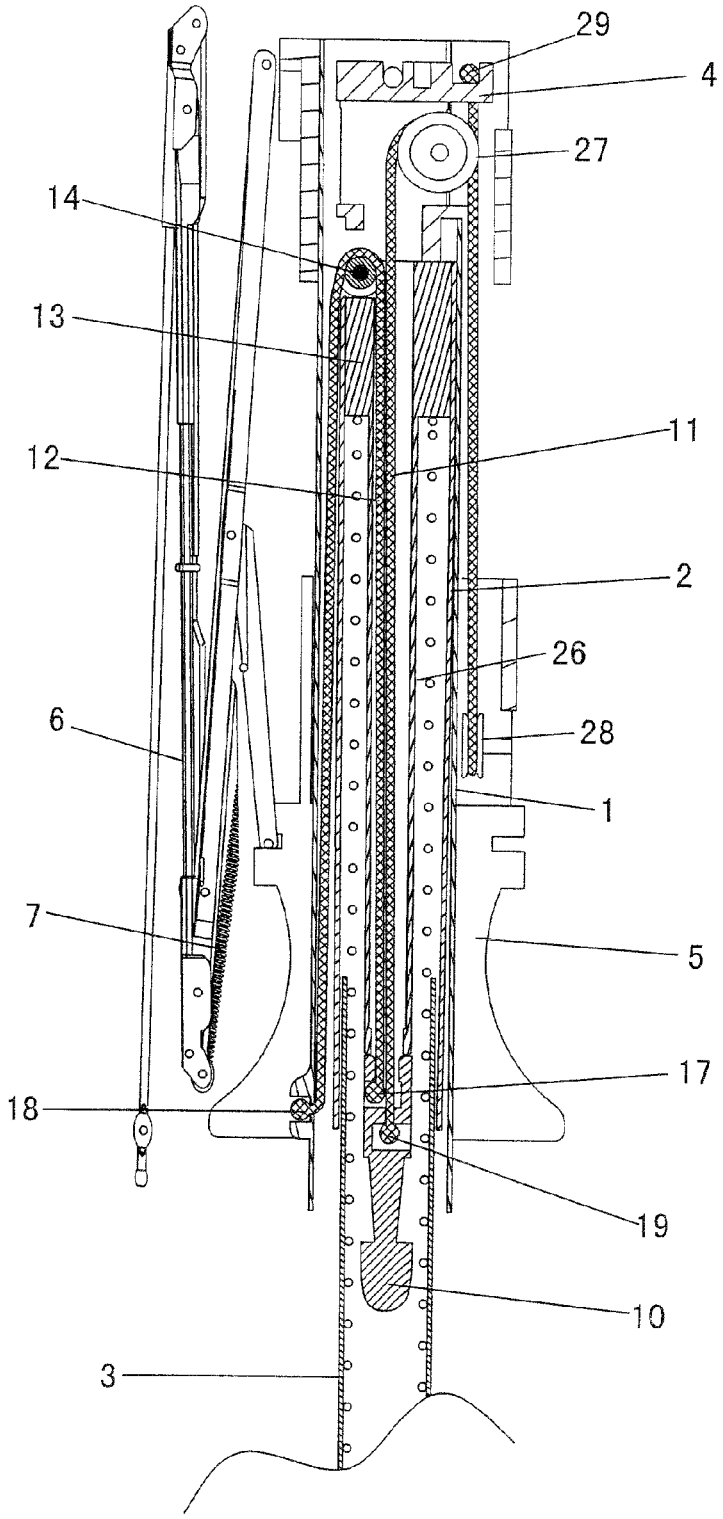
FIG. 5 is an enlarged fragmentary view, which shows the portion C in FIG. 4.

As shown in FIGS. 1-5, a first embodiment of the present invention generally comprises a tube assembly, a handle 8, rib assemblies 6, a canopy (not shown), a cap 4, and a runner 5, in which the handle 8 is fixed to a bottom end of the tube assembly, the cap 4 is fixed to a top end of the tube assembly, the runner 5 is slidably fitted around the tube assembly, each rib assembly 6 having a spring 7 is mounted between the cap 4 and the runner 5, the canopy (not shown) is mounted over the rib assemblies 6. This embodiment has a construction basically the same as the existing umbrellas. In this embodiment, the handle 8 is provided with a button 9 for opening or closing an umbrella, in which a tab 25 is provided in the handle 8 corresponding to the button 9, and a spring leaf 23 is provided in the handle 8 for engaging with the tube assembly, the tab 25 and the spring leaf 23 is mounted in the same way as the existing umbrellas. In this embodiment, the tube assembly includes an outer tube 1, a middle tube 2, and an inner tube 3, which are telescopically interconnected. Although the embodiment shows with three pieces of tube, the present invention can be implemented to be with two pieces or any pieces of tube. The inner tube 3 of the tube assembly is fixed to the handle 8. The cap 4 is fixed on top of the outer tube 1. In this embodiment, a bullet-shaped element 10 is provided in the tube assembly. The runner string 11 is connected to the bullet-shaped element 10 at a first end 19 thereof and is sequentially looped around a first runner-string pulley 27, at a top portion of the tube assembly, and a second runner-string pulley 28 of a runner 5 and then connected to a cap 4 at a second end 29 thereof. The relative position between the cap 4 and the runner 5 can be changed via the runner string 11 to achieve the purpose of closing an umbrella. In this embodiment, an outer-tube string 12 is provided in the tube assembly for moving the outer tube 1 to change the relative position between the outer tube 1 and the middle tube 2.The outer-tube string 12 is connected to the bullet-shaped element 10 at a first end 17 thereof, and is looped around an outer-tube string pulley 14 mounted on the plug 13 and then connected to a bottom portion of the outer tube 1 at a second end 18 thereof. In this embodiment, there is a protective sleeve 26 extending downwardly from the plug 13. The runner string 11 and the outer-tube string 12 are passed through the protective sleeve 26. A compression spring 15 is provided in the tube assembly, in which the spring 15 is fitted around the protective sleeve 26. One end of the spring 15 is urged against the plug 13 while the other end of the spring 15 is urged against a bottom end of the inner tube 3. In this embodiment, there is a gap defined between the outer tube 1 and the middle tube 2 so that the outer-tube string 12 can be freely moved between the outer tube 1 and the middle tube 2.

In operation, when an umbrella is in a closed state, the outer tube 1 will be fastened by the leaf spring 23. The user may press the button 9 to push the outer tube 1 to cause the leaf spring 23 to release from the outer tube 1. Thus, the compression spring 15 can push the plug 13 together with the middle tube 2 to move upwardly so that the middle tube 2 can extend away from the inner tube 3. At the same time, the outer-tube string 12 can drive the outer tube 1 to extend away from the middle tube 2, and the runner string 11 can drive the runner 5 to move upwardly to shorten the distance between the runner 5 and the cap 4 so that the rib assemblies 6 can be expanded or unfolded. Thus, a process of opening an umbrella has been completed. When the umbrella is in an opened state, the user may press the button 9 to push the bullet-shaped element 10 to move away from engaging with a bottom end of the inner tube 3, so that the bullet-shaped element 10 can retract into the tube assembly and thus the canopy (not shown) can be folded via the spring 7 of the rib assemblies 6. At the same time, the middle tube 2 can retract into the outer tube 1. Finally, the user can retract other non-retracted portion of the tube assembly by hand, which in turn push the protective sleeve 26 downwardly to have the bullet-shaped element 10 snapped into the handle 8.

Figure 6:
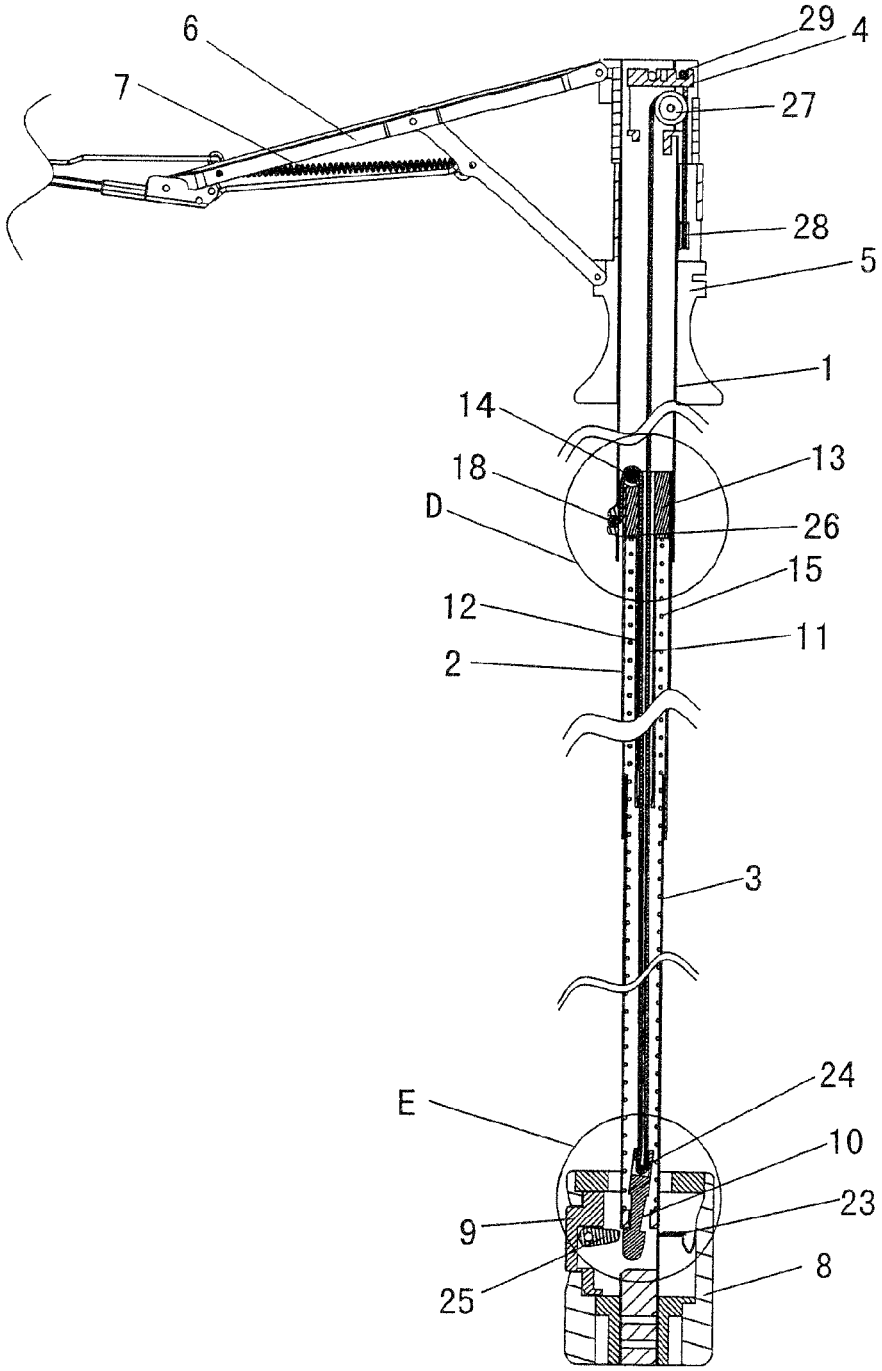
FIG. 6 is a sectional view, which schematically shows an opened state of a second embodiment of the present invention.
Figure 7:
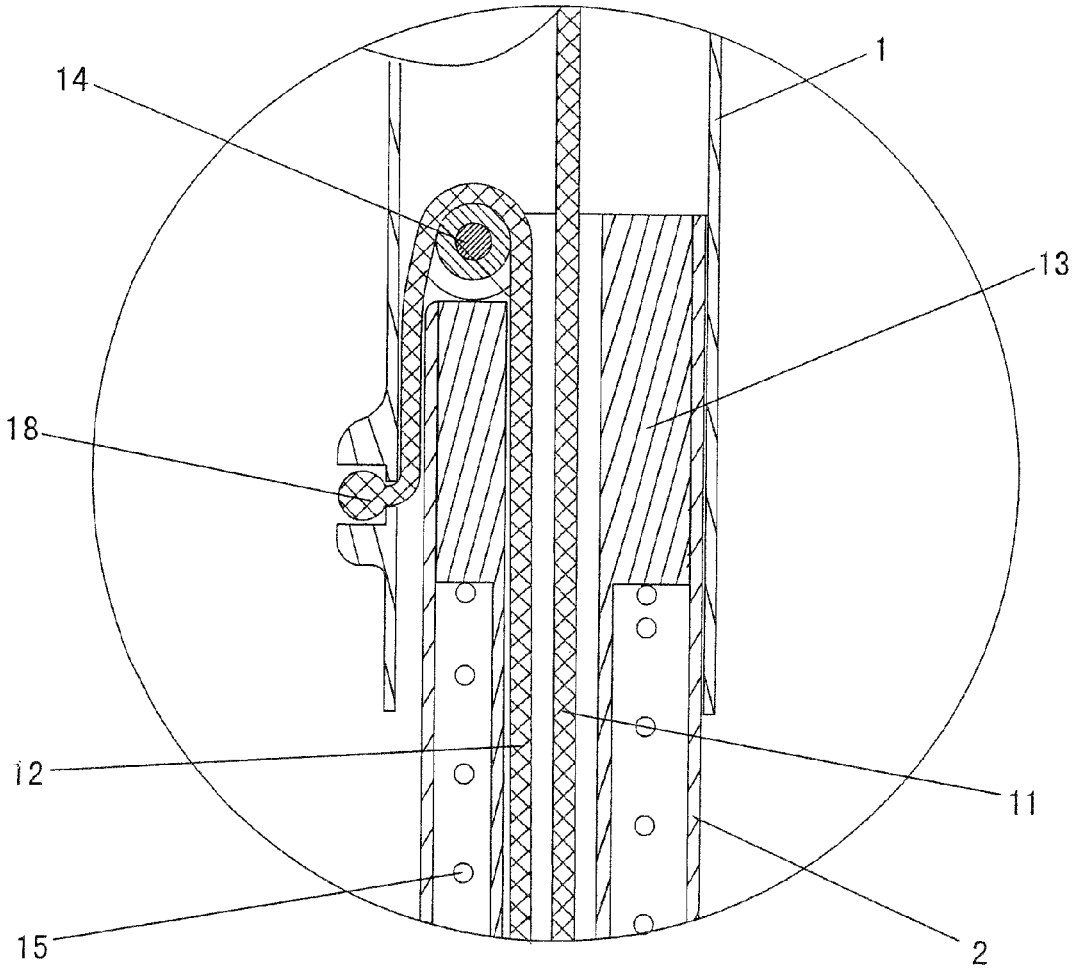
FIG. 7 is an enlarged fragmentary view, which shows the portion D in FIG. 6.
Figure 8:
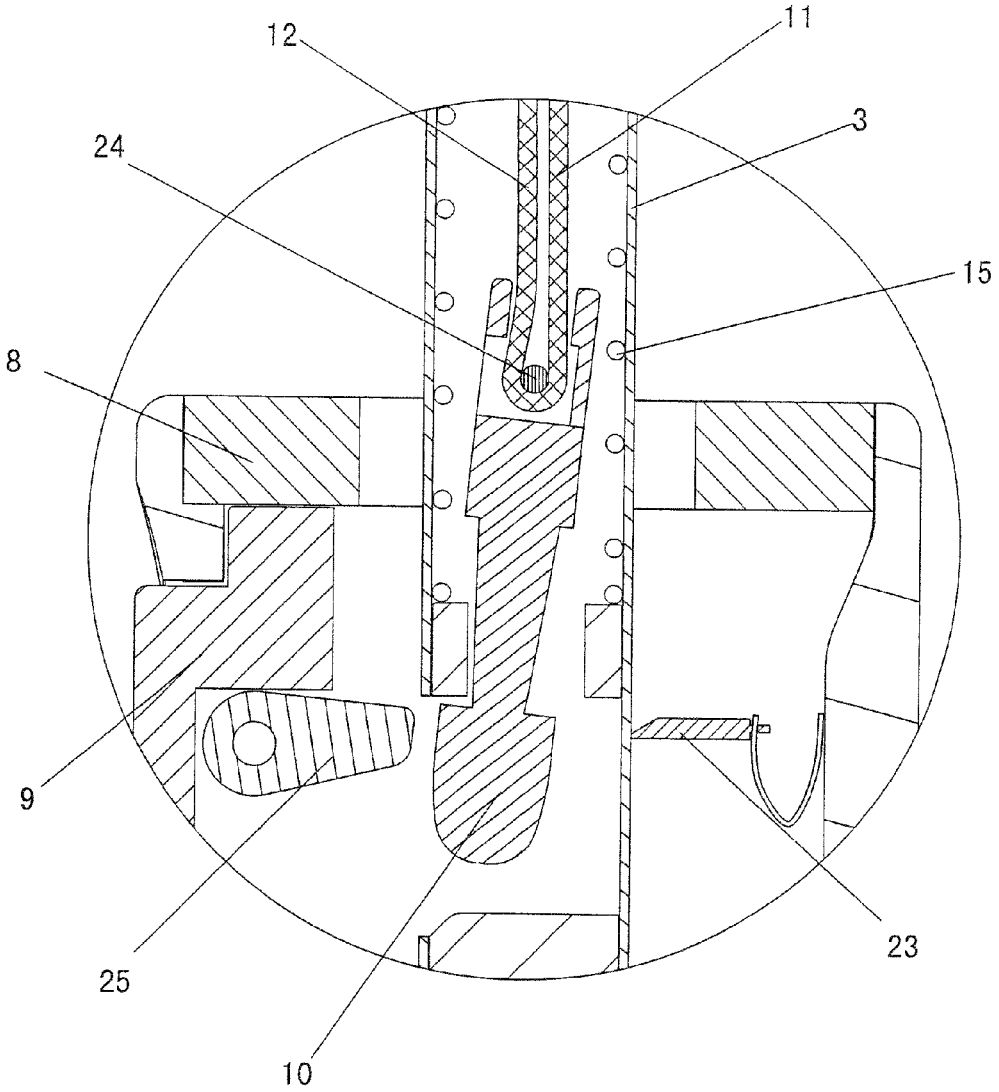
FIG. 8 is an enlarged fragmentary view, which shows the portion E in FIG. 6.
Figure 9:
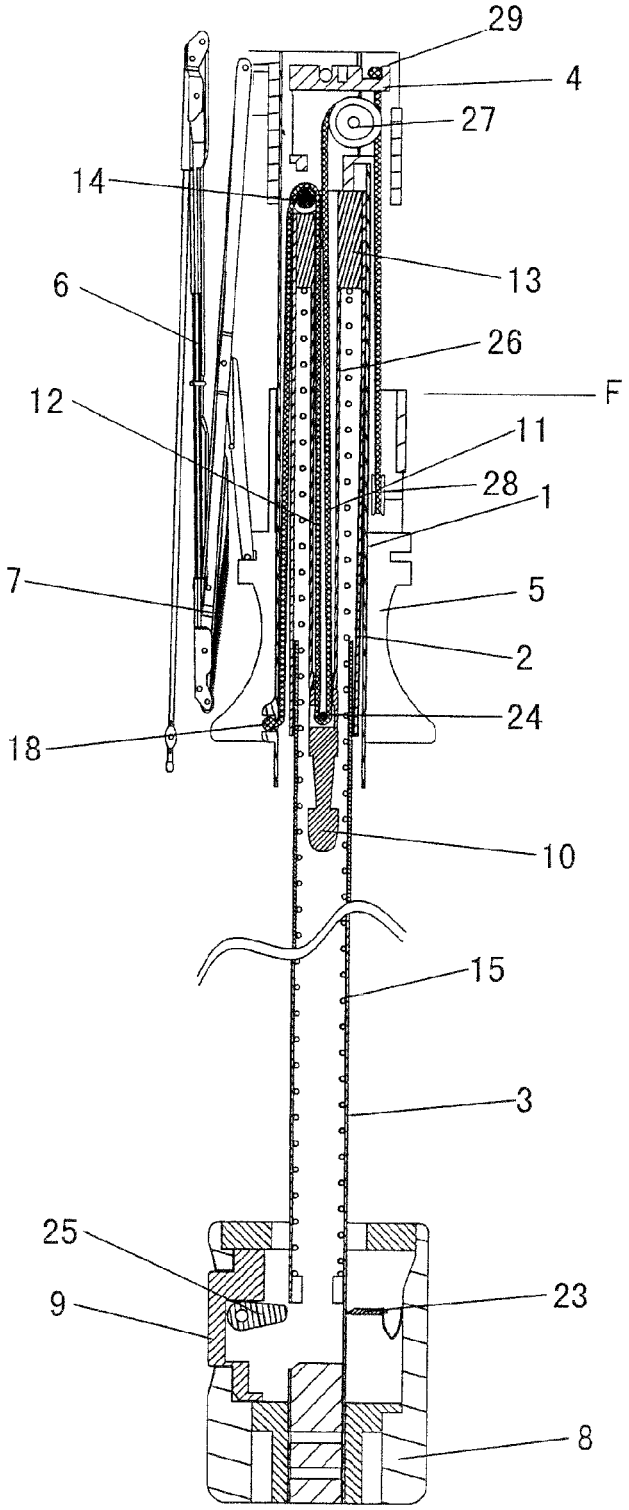
FIG. 9 is a sectional view, which schematically shows a closed state of the second embodiment of the present invention.
Figure 10:
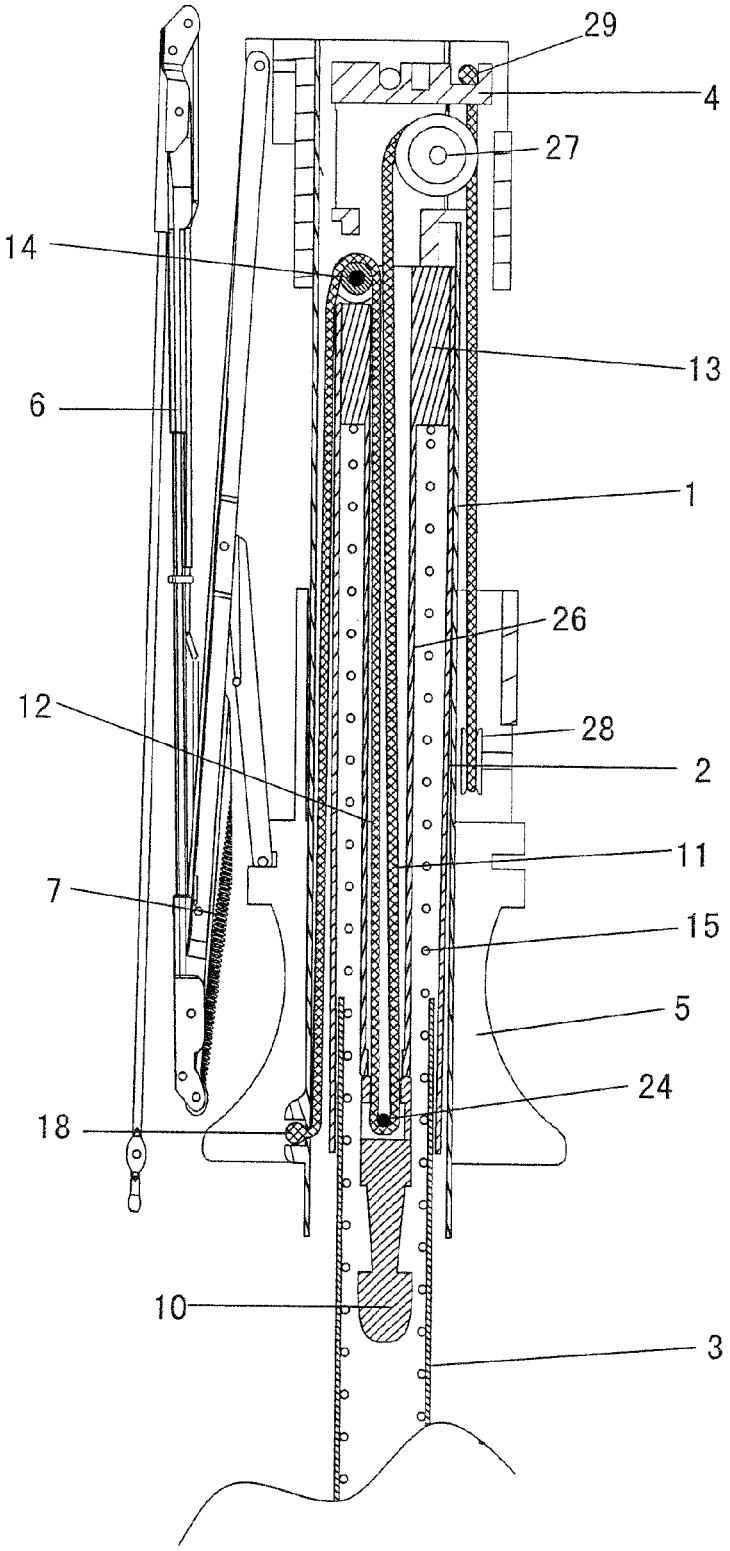
FIG. 10 is an enlarged fragmentary view, which shows the portion F in FIG. 9.

As shown in FIGS. 6-10, a second embodiment of the present invention generally has the same construction as the first embodiment. The difference between them is that the runner string 11 and the outer-tube string 12 of this embodiment are formed as an integral string, which is looped around a pin 24 of the bullet-shaped element 10. Since the operation of this embodiment is the same as that of the first embodiment, a description for it is omitted here.

Figure 11:
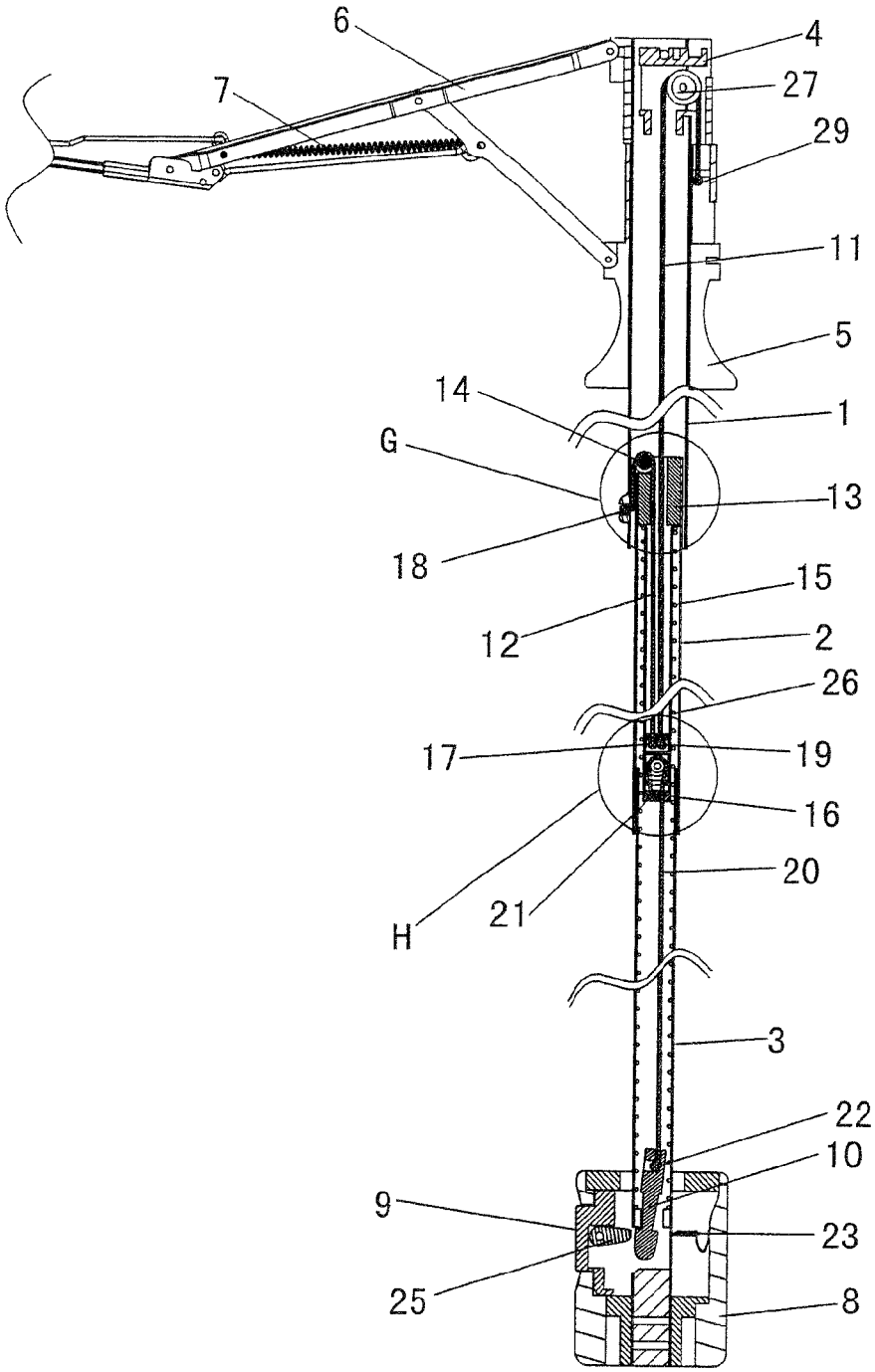
FIG. 11 is a sectional view, which schematically shows an opened state of a third embodiment of the present invention.
Figure 12:
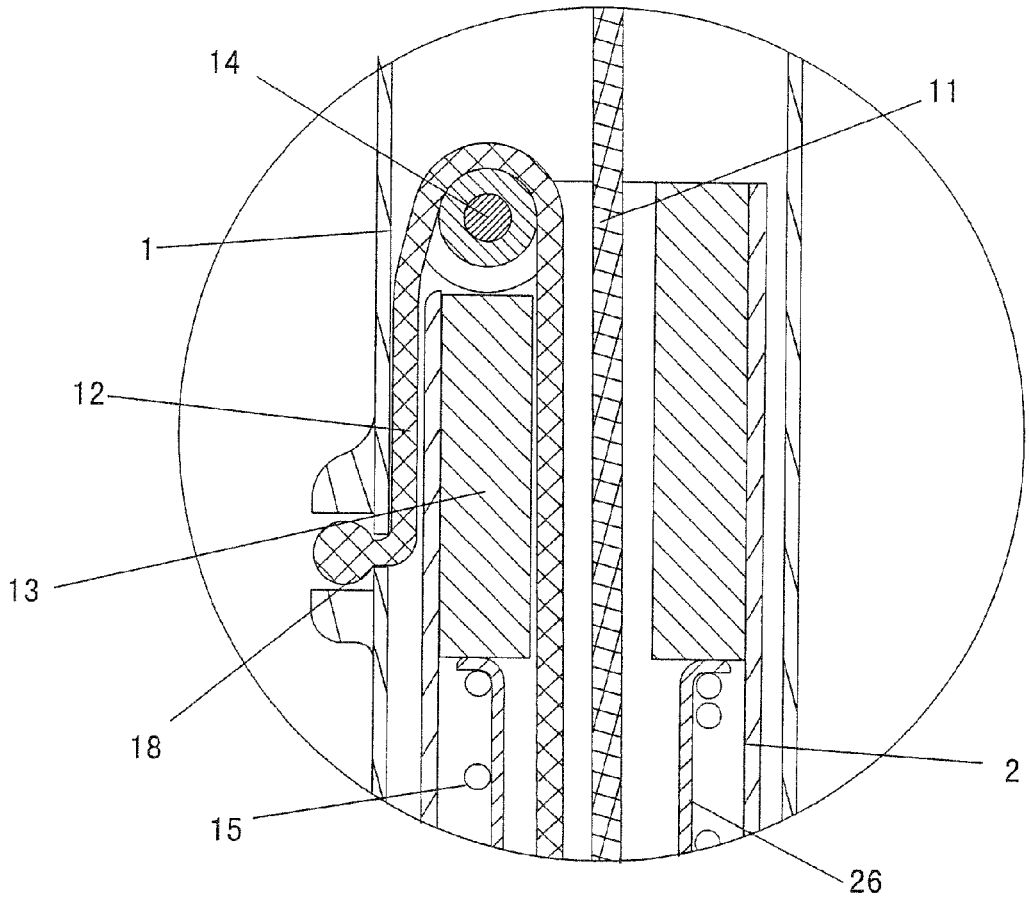
FIG. 12 is an enlarged fragmentary view, which shows the portion G in FIG. 11.
Figure 13:
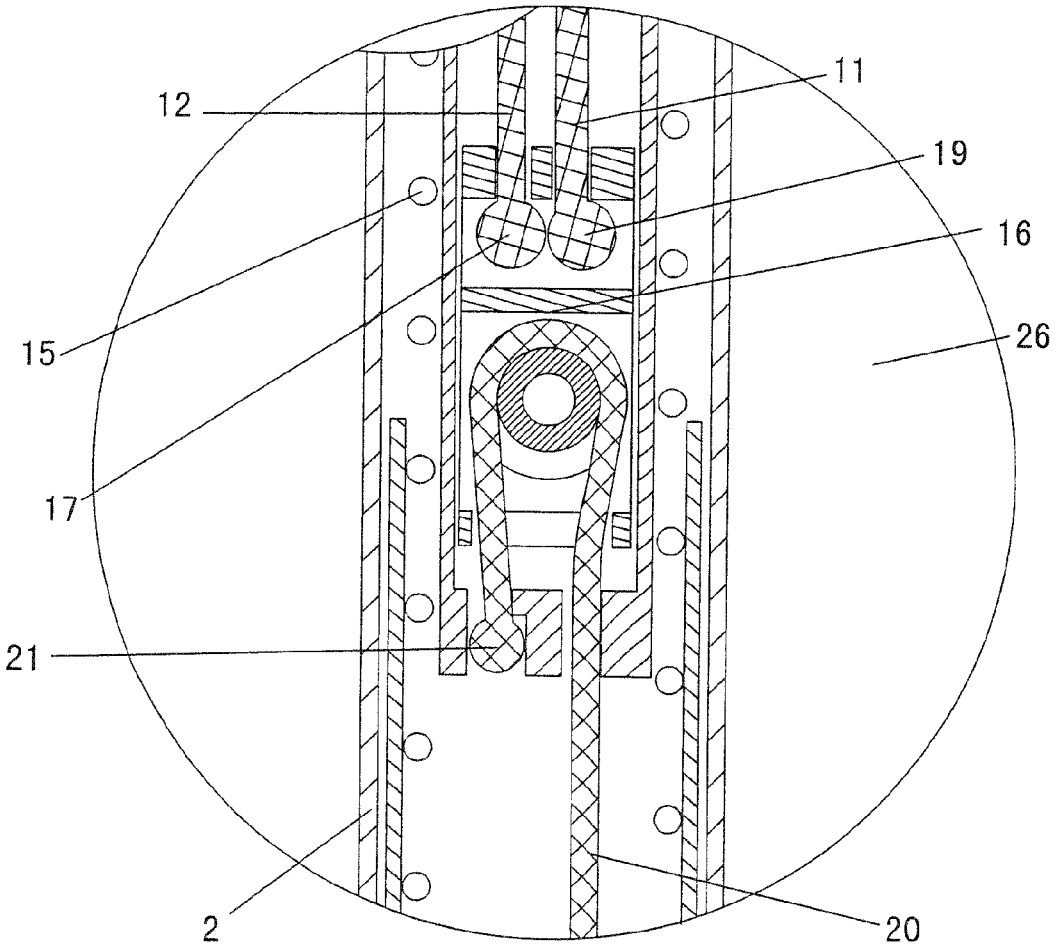
FIG. 13 is an enlarged fragmentary view, which shows the portion H in FIG. 11.
Figure 14:
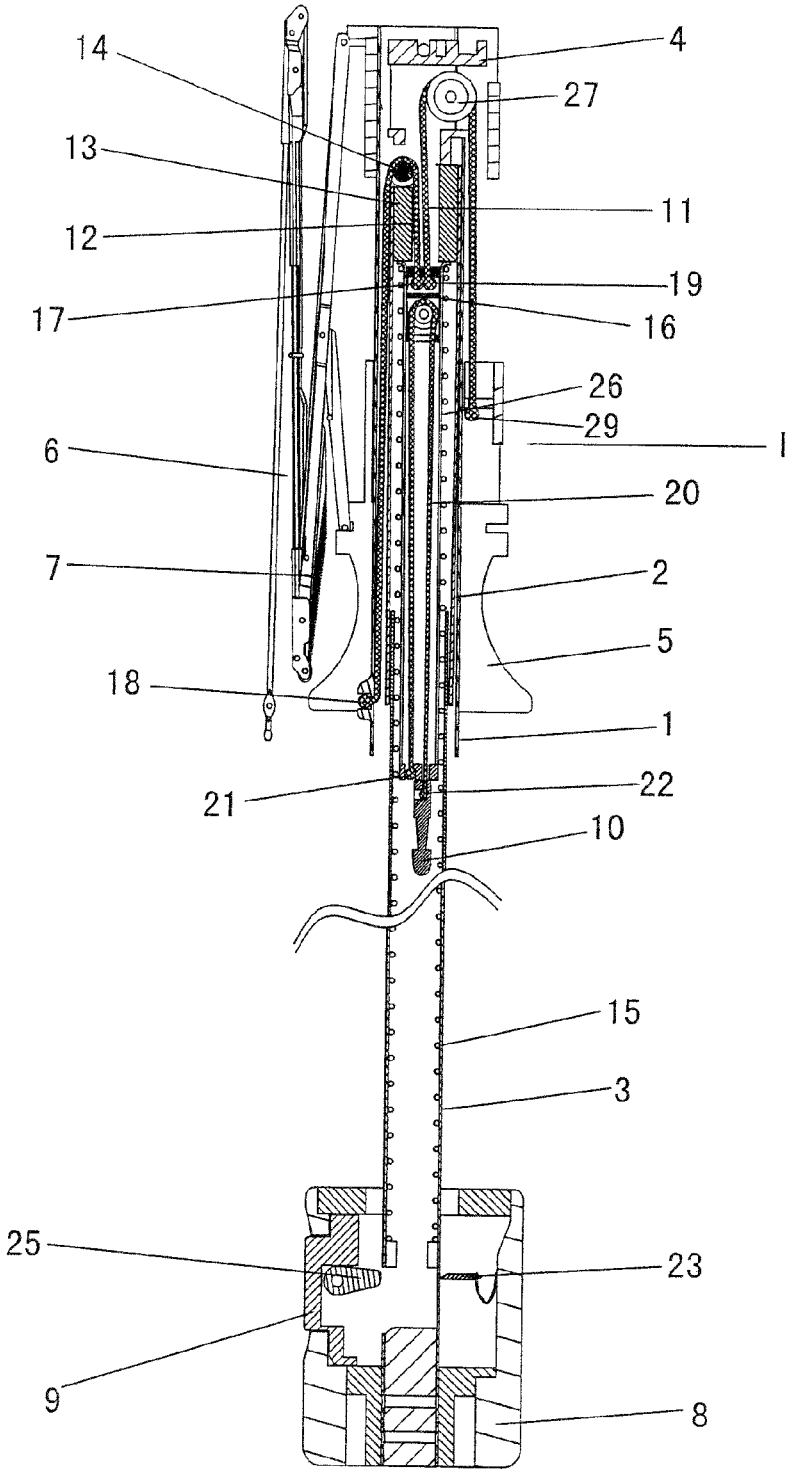
FIG. 14 is a sectional view, which schematically shows a closed state of the third embodiment of the present invention.
Figure 15:
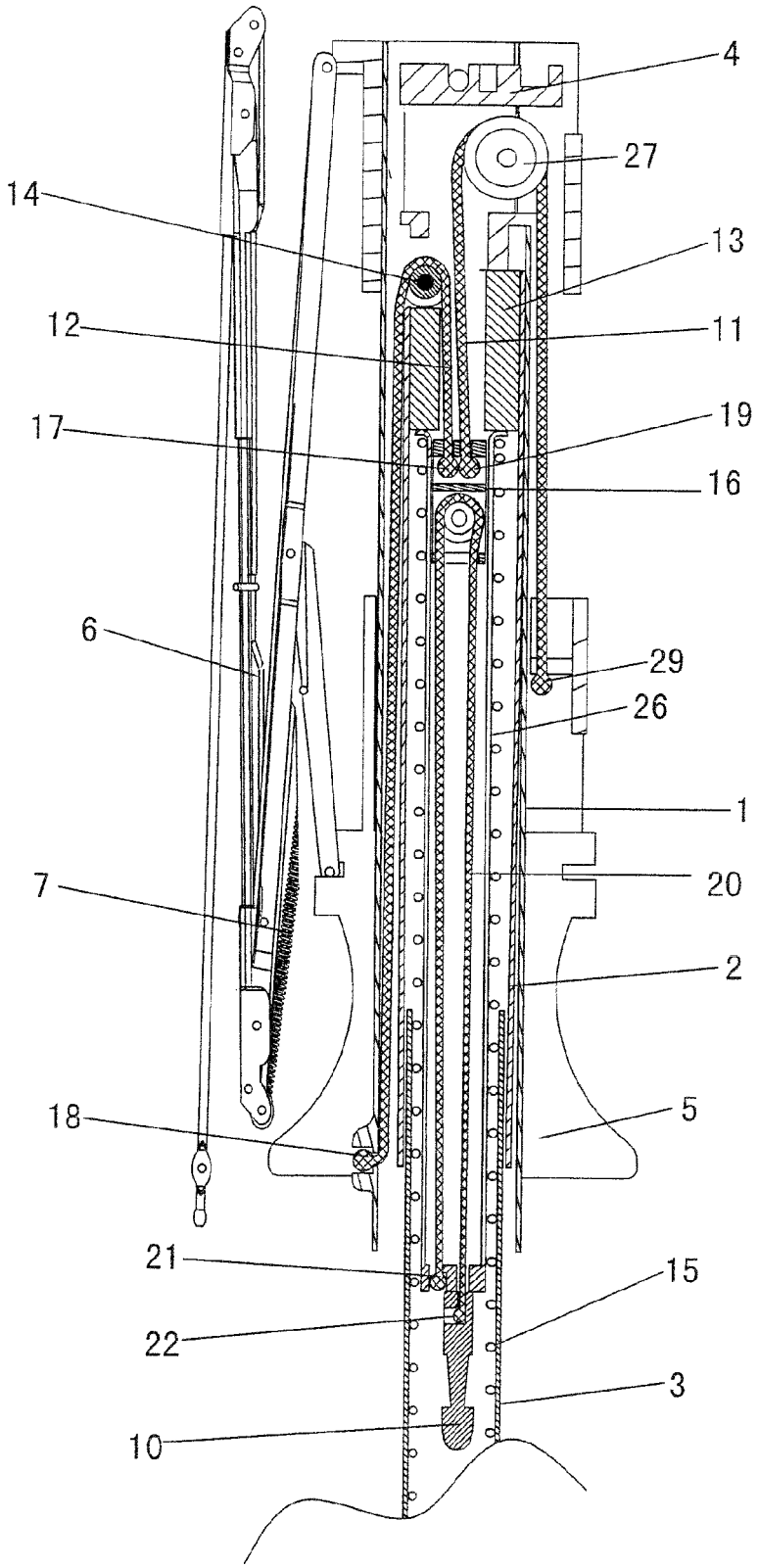
FIG. 15 is an enlarged fragmentary view, which shows the portion I in FIG. 14.

As shown in FIGS. 11-15, a third embodiment of the present invention generally has the same construction as the first embodiment. The difference between them is that this embodiment includes a sliding block 16 in the tube assembly, in which the bullet-shaped element 10 is connected with the sliding block 16 via a bullet-shaped element string 20. A first end 21 of the string 20 is looped around the sliding block 16 to be connected to a bottom portion of the protective sleeve 26. A second end 22 of the string 20 is connected to the bullet-shaped element 10. The runner string 11 and the outer-tube string 12 are connected to a top portion of the sliding block 16. The runner string 11 is connected to the sliding block 16 at a first end 19 thereof, and is looped around a first runner-string pulley 27 at a top portion of the tube assembly and then connected to a runner 5 at a second end 29 thereof. The outer-tube string 12 is connected to the sliding block 16 at a first end 17 thereof, and is looped around an outer-tube string pulley 14 of the plug 13 and then connected to a bottom portion of the outer tube 1 at a second end 18 thereof Since the operation of this embodiment is the same as that of the first embodiment, a description for it is omitted here.

Figure 16:
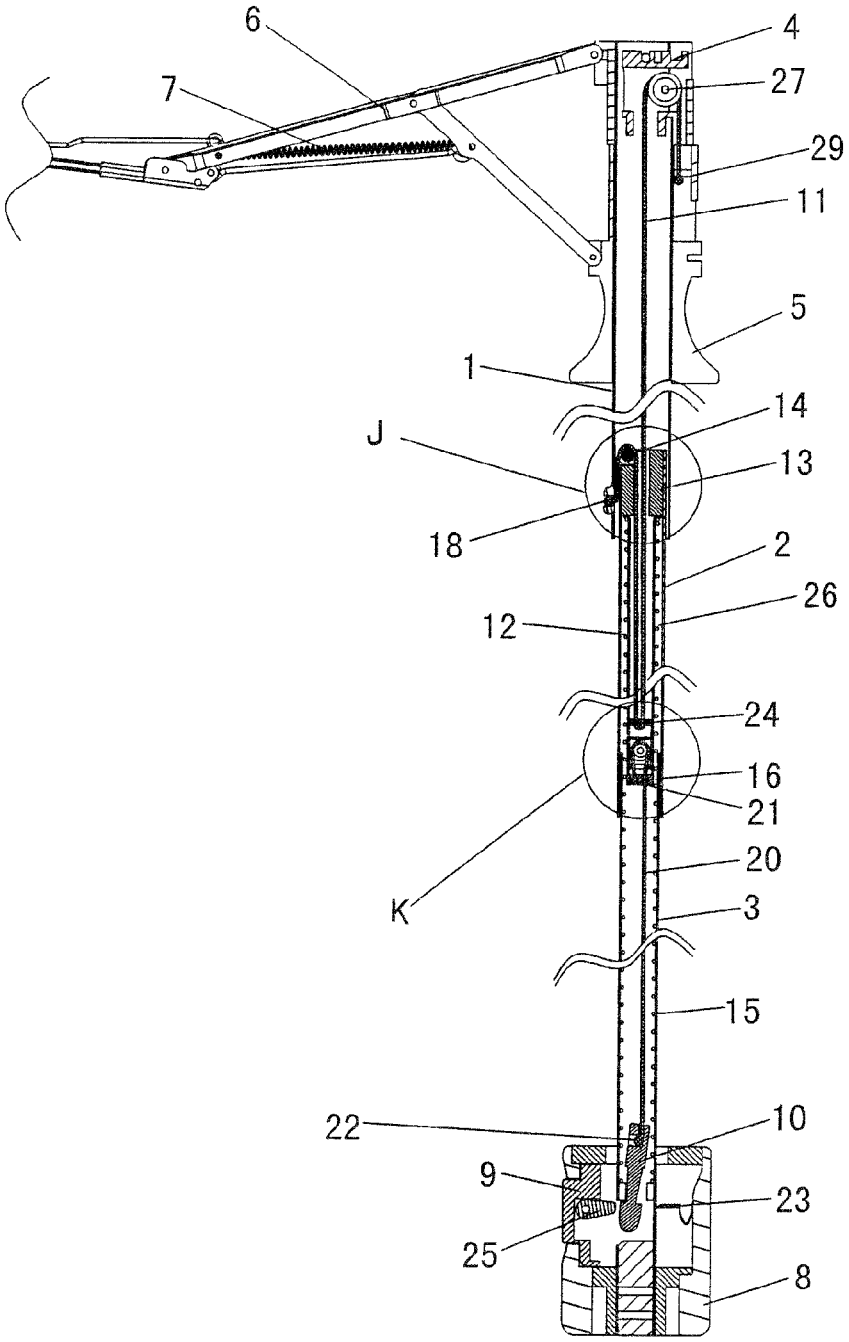
FIG. 16 is a sectional view, which schematically shows an opened state of a fourth embodiment of the present invention.
Figure 17:
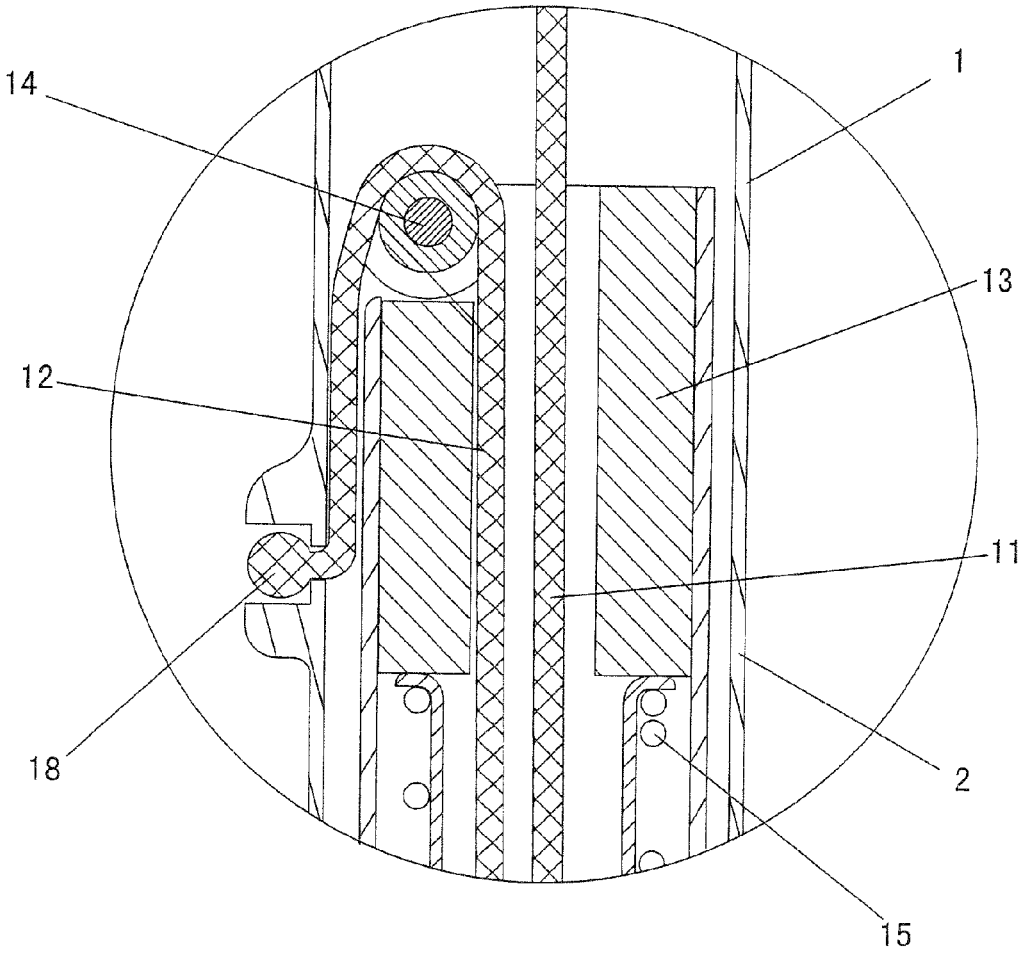
FIG. 17 is an enlarged fragmentary view, which shows the portion J in FIG. 16.
Figure 18:
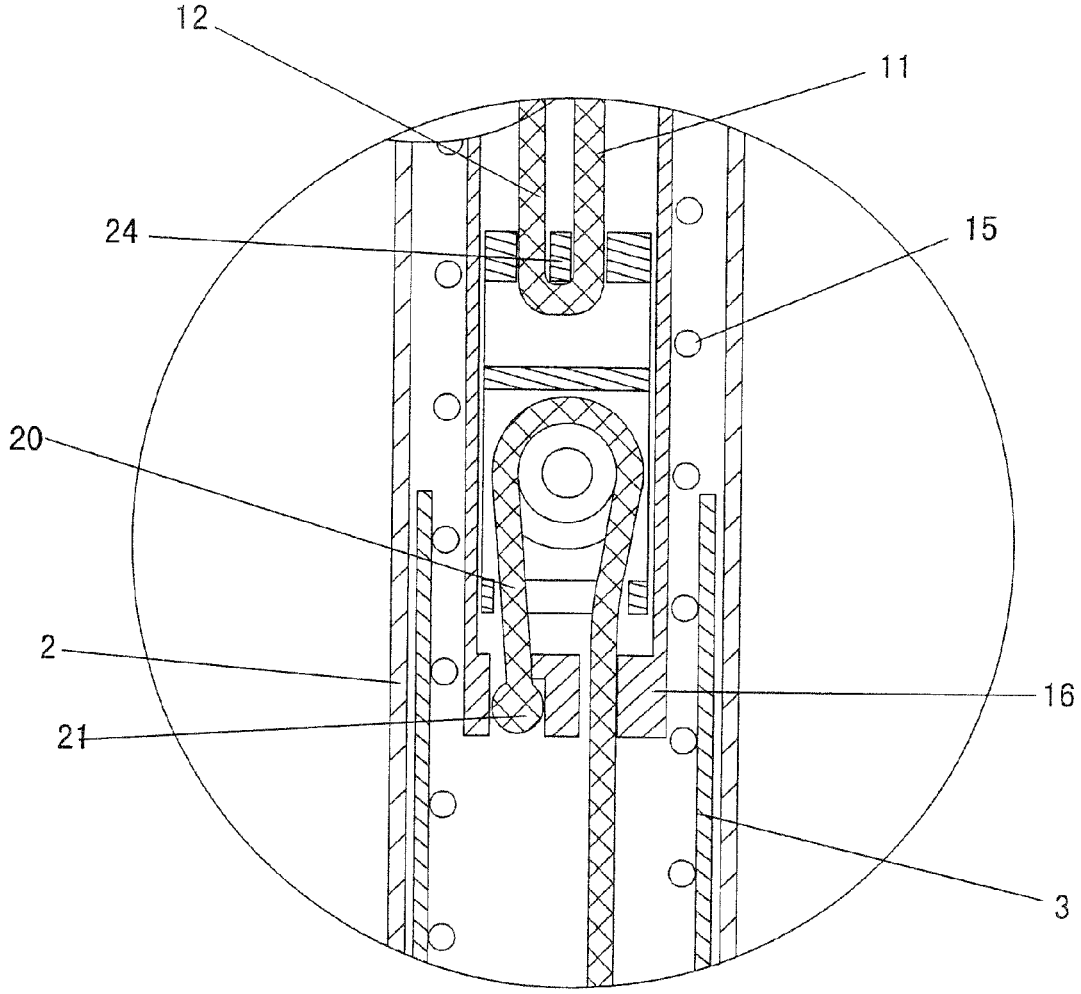
FIG. 18 is an enlarged fragmentary view, which shows the portion K in FIG. 16.
Figure 19:
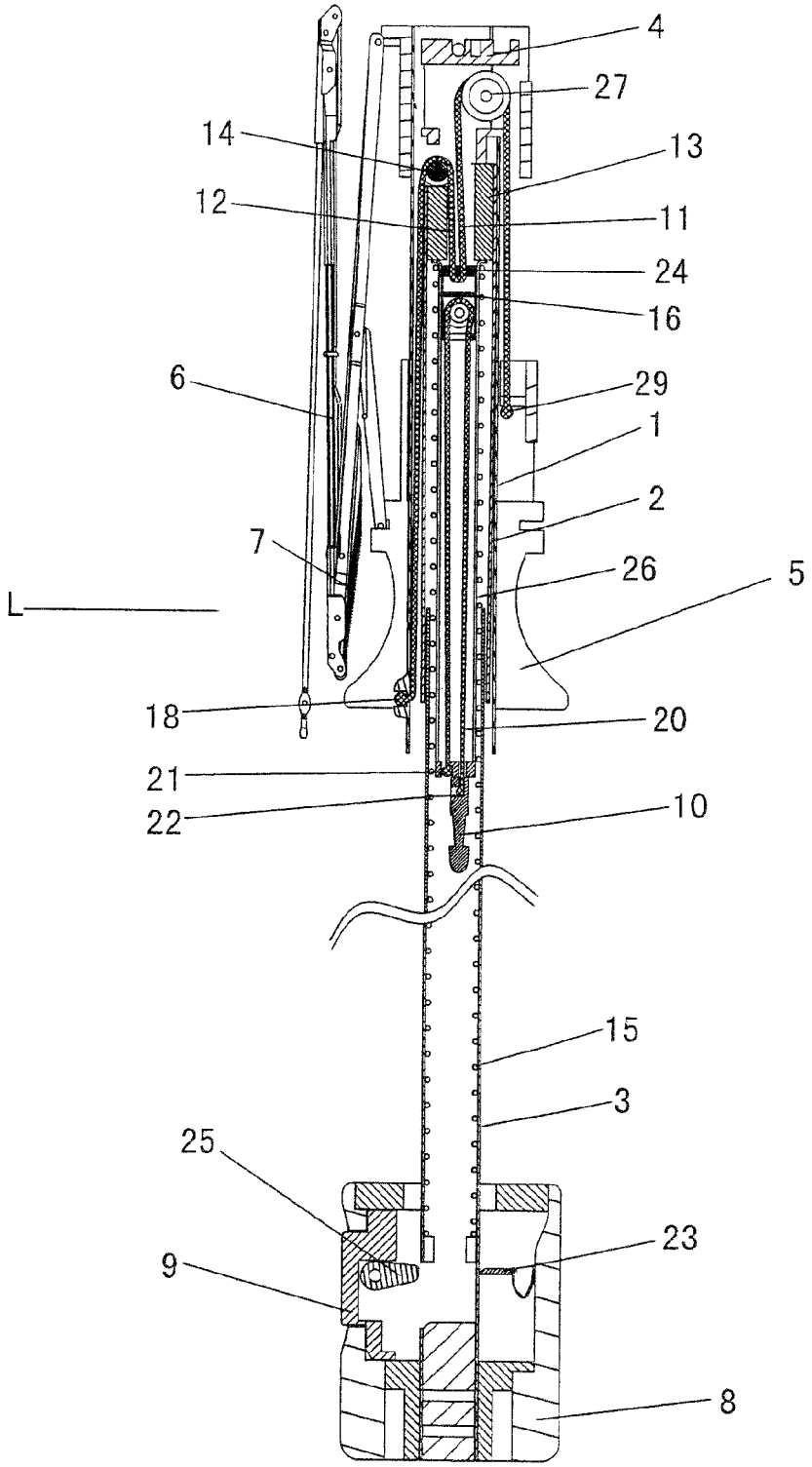
FIG. 19 is a sectional view, which schematically shows a closed state of the fourth embodiment of the present invention.
Figure 20:
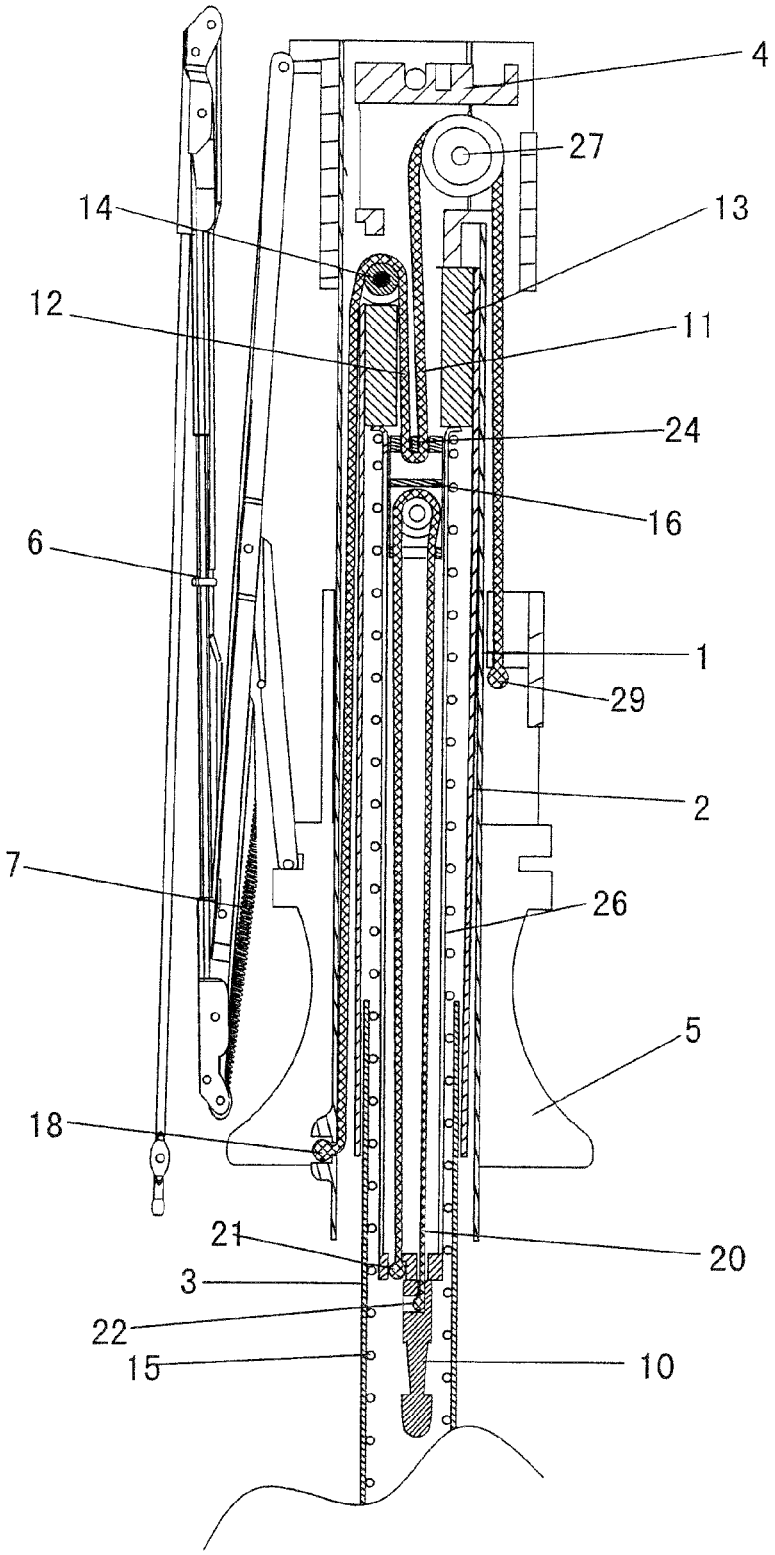
FIG. 20 is an enlarged fragmentary view, which shows the portion L in FIG. 19.

As shown in FIGS. 16-20, a fourth embodiment of the present invention generally has the same construction as the third embodiment. The difference between them is that the runner string 11 and the outer-tube string 12 of this embodiment are formed as an integral string, which is looped around a pin 24 of the sliding block 16. Since the operation of this embodiment is the same as that of the third embodiment, a description for it is omitted here.

In view of the foregoing, when closing an umbrella, the outer-tube string 12 allows the middle tube 2 to retract into the outer tube 1 automatically. Thus, the user can save one manual operation of retracting the middle tube 2. This may bring more convenience in operating an umbrella.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A telescopic tube structure for automatic umbrellas, characterized in that: the telescopic tube structure includes a tube assembly comprised of an outer tube, a middle tube, and an inner tube, which are telescopically interconnected; wherein a plug is fixedly fitted into a top portion of the middle tube, a bullet-shaped element is provided in the tube assembly, a runner string is provided in the tube assembly, the runner string being connected to the bullet-shaped element at a first end thereof, and being sequentially looped around a first runner-string pulley at a top portion of the tube assembly and a second runner-string pulley of a runner and then connected to a cap at a second end thereof, an outer-tube string is provided in the tube assembly, the outer-tube string being connected to the bullet-shaped element at a first end thereof, and being looped around an outer-tube string pulley of the plug and then connected to a bottom portion of the outer tube at a second end thereof, whereby the runner string and the outer-tube string are both fixed at the first ends thereof to the bullet-shaped element so that to open the umbrella, the runner string and the outer-tube string are simultaneously stretched to simultaneously drive the runner and the outer tube to an opened condition and to close the umbrella, the runner string and outer-tube string are simultaneously released to allow the runner and the outer tube to simultaneously move toward a closed condition.

* * * * *